US008100264B2

(12) United States Patent
Wood et al.

(10) Patent No.: US 8,100,264 B2
(45) Date of Patent: Jan. 24, 2012

(54) INTERMEDIATE BULK CONTAINER

(75) Inventors: Richard Roy Wood, Randburg (ZA); John Richard Thorpe, Darnall (ZA)

(73) Assignee: Almar Packaging (Pty) Ltd., Umlanga (ZA)

( * ) Notice: Subject to any disclaimer, the term of this patent is extended or adjusted under 35 U.S.C. 154(b) by 1093 days.

(21) Appl. No.: 10/554,510

(22) PCT Filed: Apr. 30, 2004

(86) PCT No.: PCT/ZA2004/000046

§ 371 (c)(1),
(2), (4) Date: Jul. 28, 2006

(87) PCT Pub. No.: WO2004/096661

PCT Pub. Date: Nov. 11, 2004

(65) Prior Publication Data

US 2007/0034627 A1 Feb. 15, 2007

(30) Foreign Application Priority Data

May 2, 2003 (ZA) ..... 03/3394

(51) Int. Cl.
*B65D 19/02* (2006.01)

(52) U.S. Cl. ..... 206/600; 220/1.5

(58) Field of Classification Search ..... 206/509, 206/511, 600, 386, 595, 598; 220/9.4, 495.06, 220/668, 1.5, 23.4, 23.83, 23.86; 108/53.1
See application file for complete search history.

(56) References Cited

U.S. PATENT DOCUMENTS 3,439,865 A * 4/1969 Port et al. ..... 383/117
4,289,872 A 9/1981 Denkewalter et al.
4,347,551 A * 8/1982 Tanaka ..... 361/307
(Continued)

FOREIGN PATENT DOCUMENTS

EP 0 339 695 A2 11/1989
(Continued)

OTHER PUBLICATIONS

Groome, Illingworth, O'Brien, Priddle, Weaver & McNeilly, Quantification of Inhibin Pro-αC-Containing Forms in Human Serum by a New Ultrasensitive Two-Site Enzyme-Linked Immunosorbent Assay, Journal of Clinical Endocrinology and Metabolism, 1995, pp. 2926-2932, vol. 80, No. 10, by The Endocrine Society, USA.

*Primary Examiner* — Jacob K Ackun
*Assistant Examiner* — Kareen Rush
(74) *Attorney, Agent, or Firm* — Young & Thompson

(57) ABSTRACT

An intermediate bulk container includes a flexible storage container, a rigid rectangular base member including a plurality of pole engaging formations on its upper surface which are arranged about its periphery, a plurality of poles, the lower end of each of which is releasably engageable with a pole engaging formation on the base so that the poles collectively provide a support cage for the storage container, a rigid pole location member (10) which includes a central opening through which the support container may be filled and a plurality of pole engaging formations with which the upper ends of the poles are releasably engageable, and bracing elements connecting a pair of poles on at least two adjacent sides of the cage to each other for holding the poles, in the planes in which they are located in the assembled container, perpendicular to the base and pole locating member.

20 Claims, 3 Drawing Sheets

U.S. PATENT DOCUMENTS

| | | | | | |
|---|---|---|---|---|---|
| 4,376,861 | A | | 3/1983 | Lalk et al. | |
| 4,421,356 | A | * | 12/1983 | Singer | 297/16.1 |
| 4,507,466 | A | | 3/1985 | Tomalia et al. | |
| 4,515,920 | A | | 5/1985 | Erickson | |
| 4,517,122 | A | | 5/1985 | Tomalia et al. | |
| 4,558,120 | A | | 12/1985 | Tomalia et al. | |
| 4,568,737 | A | | 2/1986 | Tomalia et al. | |
| 4,587,329 | A | | 5/1986 | Tomalia et al. | |
| 4,599,400 | A | | 7/1986 | Tomalia et al. | |
| 4,600,535 | A | | 7/1986 | Tomalia et al. | |
| 4,703,702 | A | | 11/1987 | Speicher | |
| 4,817,824 | A | | 4/1989 | LaFleur et al. | |
| 4,864,019 | A | | 9/1989 | Vale et al. | |
| 5,015,729 | A | | 5/1991 | Spiess et al. | |
| 5,025,925 | A | * | 6/1991 | Wiklund | 206/386 |
| 5,126,680 | A | * | 6/1992 | Morin et al. | 324/724 |
| 5,154,286 | A | * | 10/1992 | Gits | 206/386 |
| 5,229,490 | A | | 7/1993 | Tam | |
| 5,437,384 | A | * | 8/1995 | Farrell | 220/1.5 |
| 5,580,563 | A | | 12/1996 | Tam | |
| 5,667,002 | A | * | 9/1997 | Neustadt | 160/368.1 |
| 5,725,858 | A | | 3/1998 | Fioretti et al. | |
| 5,747,659 | A | | 5/1998 | Fioretti et al. | |
| 5,786,179 | A | | 7/1998 | Kousoulas et al. | |
| 5,882,645 | A | | 3/1999 | Toth et al. | |
| 5,897,012 | A | * | 4/1999 | Sortwell | 220/4.28 |
| 6,235,716 | B1 | | 5/2001 | Ben-Sasson | |
| 6,247,594 | B1 | * | 6/2001 | Garton | 206/512 |
| 6,310,180 | B1 | | 10/2001 | Tam | |
| 6,371,299 | B1 | * | 4/2002 | Essary | 206/600 |
| 6,389,743 | B1 | * | 5/2002 | Stephenson | 47/43 |
| 6,514,009 | B2 | * | 2/2003 | Northcott et al. | 405/53 |
| 7,070,608 | B2 | * | 7/2006 | Kurz et al. | 606/200 |
| 7,140,516 | B2 | * | 11/2006 | Bothor et al. | 222/185.1 |
| 7,431,173 | B2 | * | 10/2008 | Thorpe | 220/9.4 |
| 2001/0051079 | A1 | * | 12/2001 | Arai | 410/77 |

FOREIGN PATENT DOCUMENTS

| | | |
|---|---|---|
| EP | 0 472 360 | 2/1992 |
| EP | 0 589 483 | 3/1994 |
| FR | 2 639 037 | 5/1990 |
| GB | 2 189 773 | 11/1987 |
| WO | WO 98/01370 | 1/1998 |
| WO | WO 00/25831 | 5/2000 |
| WO | WO 2004/043141 A3 | 5/2004 |

* cited by examiner

INTERMEDIATE BULK CONTAINER

FIELD OF THE INVENTION

This invention relates to a knock-down intermediate bulk container of the type which comprises a bulk storage bag which is made from a flexible material for containing particulate material, discrete objects or liquid and a support structure in which the bag is located to inhibit lateral bulging of the loaded bag in use.

SUMMARY OF THE INVENTION

An intermediate bulk container comprising a storage container which is made from a suitable flexible material, a rigid substantially rectangular base member including a plurality of pole engaging formations on its upper surface which are arranged in a spaced relationship about its periphery, a plurality of poles, the lower end of each of which is releasably engageable with a pole engaging formation on the base to be perpendicular to the general plane of the upper surface of the base so that the poles collectively provide a support cage for the storage container, a rigid pole location member which includes a central opening through which the support container may be filled and a plurality of pole engaging formations with which the upper ends of the poles are releasably engageable, and bracing means connecting a pair of poles on at least two adjacent sides of the cage to each other for holding the poles, in the planes in which they are located in the assembled container, perpendicular to the base and pole locating member.

The pole bracing means may consist of two elongated tension resisting members which are each attached to and extend diagonally between the upper and lower end portions of the pair of poles to which they are connected.

In a preferred form of the invention the tension resisting members are flexible. Conveniently the tension resisting members are made from stranded metal cable.

The base member is preferably a forklift pallet.

The underside of the pallet base member and the upper surface of the pole locating member may both include interengageable formations which are releasably engageable with compatible formations on intermediate bulk containers of the invention above and below it in a stack to prevent horizontally transverse dislocation of one container from another in a stack.

The pallet base may in one form of the invention be square or rectangular in plan and is moulded from a suitable plastics material. The pole locating member may have the same shape in plan as the pallet base and is moulded from plastic material. Preferably both the pallet base and the pole locating member are moulded to be substantially hollow.

The pole engaging formations on the pallet base and the pole location member are preferably sockets in which the end portions of the poles are frictionally engaged, in use, to inhibit skewing of the poles in the plane in which they are located relatively to the components with which they are engaged.

The upper surface of the pallet base may include, between the pole sockets, elongated recesses in which poles may be stored and trapped when the pole location member is placed on the pallet base.

The pallet base and the pole location member conveniently each include sixteen pole engaging sockets which are arranged in sets of five alongside each of their four outer edges with the corner sockets each being common to two sets of sockets. The central socket of each of the four sets of sockets may be positioned closer to the centre of the pallet base and pole location member with the remaining sockets in each set being aligned and parallel to an outer edge of the pallet base and pole location member outwardly of its central socket.

The poles could be made from metal with their upper and lower ends being rounded with the bases of the sockets in the pallet base and pole location member in which they are located, in use, being complementally shaped to the rounded pole ends.

When a plurality of loaded bulk containers are stacked vertically one on the other with their dislocation preventing formations engaged with those of a vertically adjacent container in the stack their posts are preferably in axial alignment with their ends separated from each other by solid material from which the pallet bases and the pole locating members are made so that the mass of the loaded containers above the base container of the stack is conveniently transmitted from their pallet bases only through the axially aligned poles to the surface on which the containers are stacked and not through the material in their storage containers.

The pallet base conveniently carries a central load discharge aperture. The pallet base may further include a plug for closing the discharge aperture from the underside of the pallet with the side of the plug including formations which are releasably engageable in formations in the wall of the pallet base aperture releasably to lock the plug in the aperture.

The pallet base may include in its underside two pairs of parallel sided forklift tine recesses with one pair of recesses extending across the pallet base from opposite sides of the base and the other pair from the remaining opposite sides to define four corner load supporting plinths and a single elongated plinth between each pair of corner plinths. The dislocation preventing formations on the pallet base are preferably elongated recesses in the undersides of the elongated load support plinths.

The dislocation preventing formations on the pole location member may be formations which project upwardly from the upper surface of the member and are substantially complementally shaped to the pallet base recesses so that when the bulk containers are stacked one on the other the formations on the pole locating members are releasably engaged in the recesses of the pallet bases of containers above them in the stack.

The pallet base and pole locating member dislocation preventing formations may have rectangular bases with each of the four sides of each formation tapering inwardly towards the opposite side of the formation.

The pole locating member may be a ring beam.

In one form of the invention the storage container may be a bag which is made from a suitable plastics film material. The thickness gauge of the film may lie in the range of between 90 and 120 microns.

The storage bag may be made from a woven plastics material. The woven bag material may in certain applications be internally laminated with a suitable plastic film for containing a liquid or highly hydroscopic particulate material.

The storage bag in yet a further version may be made from a netting material.

In another form of the invention the storage container may be moulded from a suitable flexible plastic material and include a closable filling aperture and if required an outlet aperture.

A passive programmable microchip which is information accessible from an external electronic source may be embedded in a component of the bulk container.

BRIEF DESCRIPTION OF THE DRAWINGS

An embodiment of the invention is now described by way of example only with reference to the drawings in which.

DETAILED DESCRIPTION OF THE PREFERRED EMBODIMENT

Figure 1:
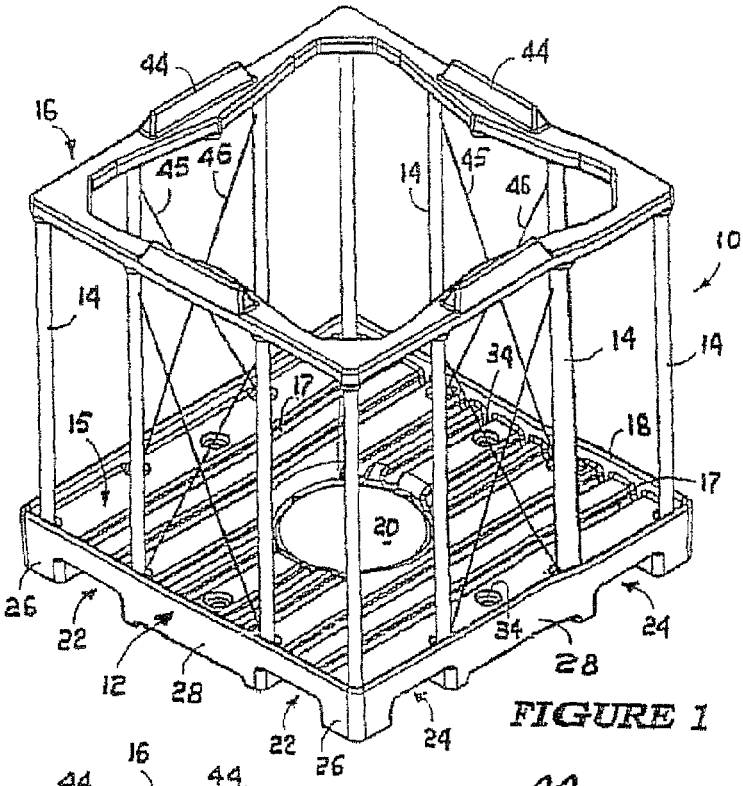
FIG. 1 is a perspective view from above of the intermediate bulk container of the invention.

The intermediate bulk container 10 of the invention is shown in the drawings to include a forklift pallet base 12, restraining poles 14 and a pole locating member or ring beam 16 which together provide a support cage for a storage container.

The pallet base 12 is rotor moulded, to be substantially hollow, from a suitable plastics material such as linear low density polyethylene and is most clearly shown in FIGS. 1, 2, 6 and 7 to include a flat upper surface 15 into which a series of pole locating grooves 17 are moulded, an upstanding peripheral rim 18 and a centrally located circular discharge aperture 20. The pole locating grooves 17 have been omitted from FIG. 6 for clarity of illustration.

Figure 2:
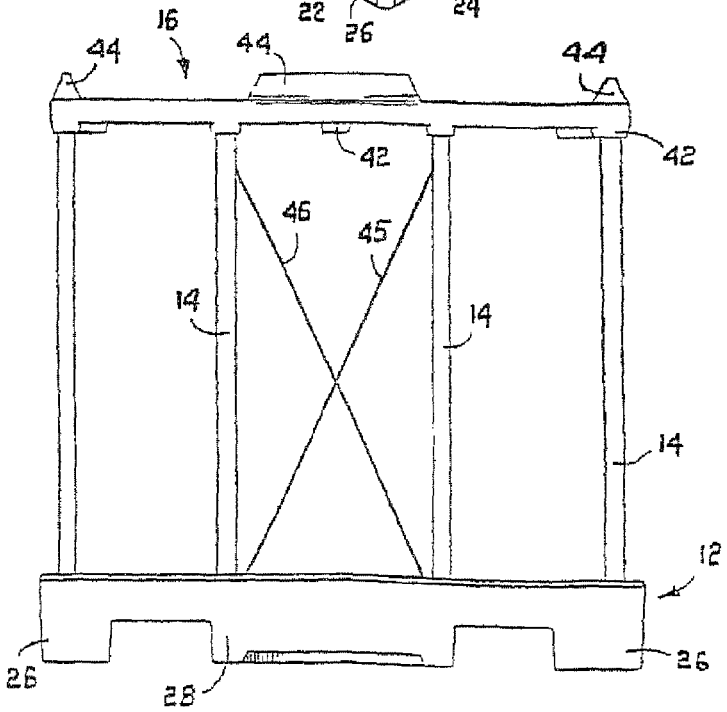
FIG. 2 is a side elevation of the container of FIG. 1.
Figure 7:
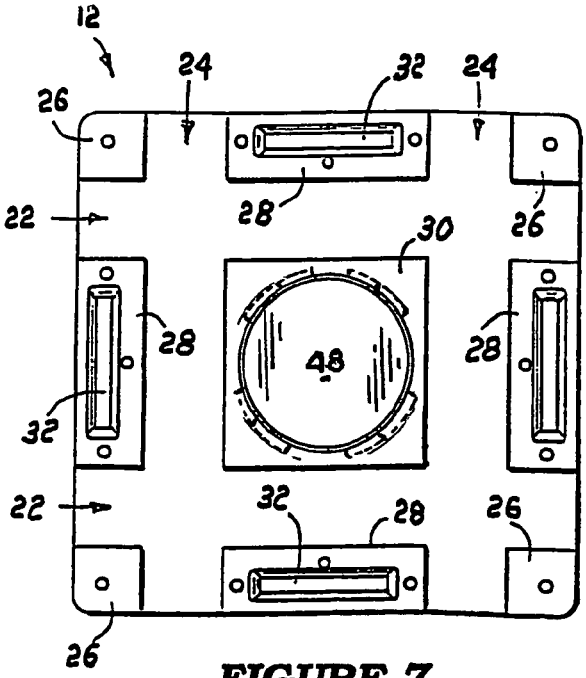

The underside of the pallet base, as seen in FIGS. 1, 2 and 7, includes two pairs of parallel sided recesses 22 and 24 with each pair of recesses being dimensioned and spaced to provide forklift tine recesses which are accessible from any one of the four sides of the pallet base. The pairs of recesses 22 and 24 define between them four substantially square corner support plinths 26, elongated support plinths 28 between the corner plinths and a shallower central protuberance 30 which carries the discharge outlet 20. The elongated intermediate support plinths 28 each carry an elongated recess 32.

Figure 6:
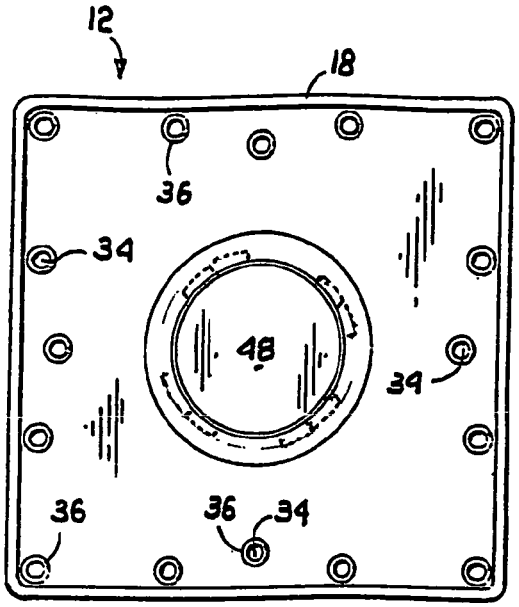
FIGS. 6 and 7 are respectively a plan view and an under plan view of the pallet base of the container.

Returning to the upper surface of the pallet, it is shown in FIG. 6 that the pallet, in this embodiment of the invention, includes 16 pole sockets which are arranged in the upper surface as shown in the drawing with each of the pole sockets including a counter-sunk upper mouth portion 36 which surrounds the pole 14 locating socket 34. Also, as shown in FIG. 1, each of the pallet base sockets 34 are located in the plinth supports 26 or 28 to provide the sockets with adequate depth solidly to frictionally engage the lower end of the poles 14 against skewing. The lower ends of the sockets are located in solid material at the undersides of the plinth supports for competent load transfer between the ends of the poles and the underside of the plinths in which they are located.

Figure 4:
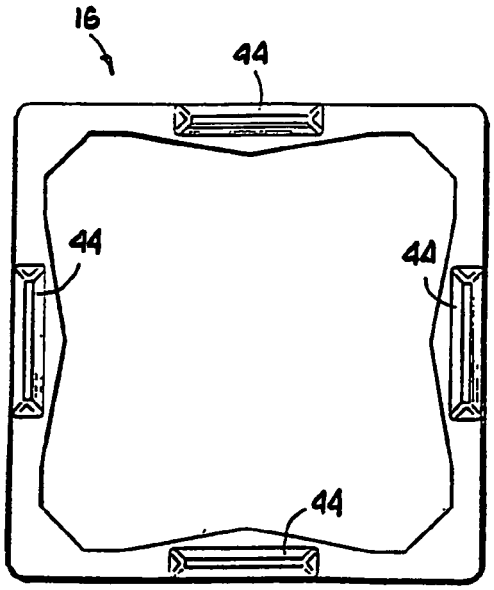

The ring beam 16, as shown in FIGS. 1, 2 4 and 5, is moulded in the same manner as the pallet base 12 and includes on its underside sixteen sockets 40 which are arranged in exactly the same configuration as the sockets 34 on the pallet base 12. The sockets 40 extend, as shown in FIG. 2, into the ring beam through formations 42 which project from the underside of the beam 16 towards the pallet base. The upper surface of the ring beam carries four upwardly projecting formations 44 which are releasably engageable in the recesses 32 in the undersides of the intermediate pallet base plinths 28, as shown in FIG. 7. As seen in FIGS. 2, 4 and 7 the ring beam formations 44 and the pallet base recesses 32 are elongated and include four sides which are inclined towards their opposite sides for ease of engagement and release from one another in a stack of the containers.

The poles 14 are made from mild steel tubing which is suitably galvanised or otherwise coated against atmospheric degradation and importantly their upper and lower ends are smoothly rounded, as are the bases of the sockets 34 and 40, in which they are located in use. The rounded pole ends spread what could be substantial loads which are imposed on them in their axial direction, in use, into the pallet material surrounding the sockets in which they are intimately seated to minimise punching or other damage to the sockets and the material surrounding them.

Figure 3:
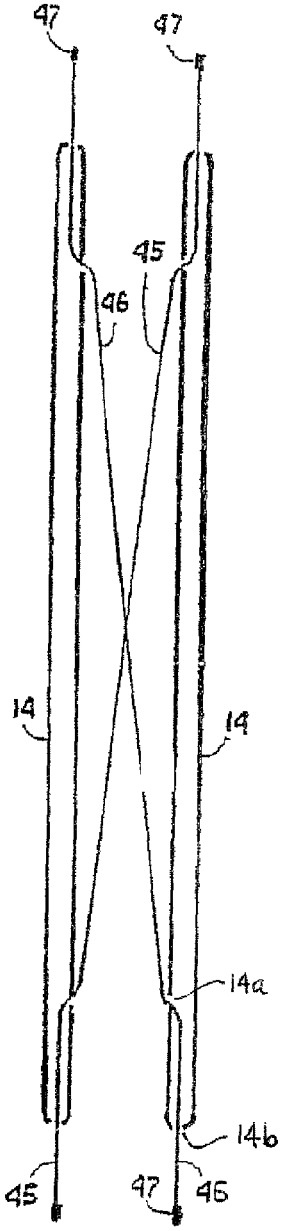
FIG. 3 is a partially diagrammatic sectioned side elevation of two braced poles of the container.
Figure 5:
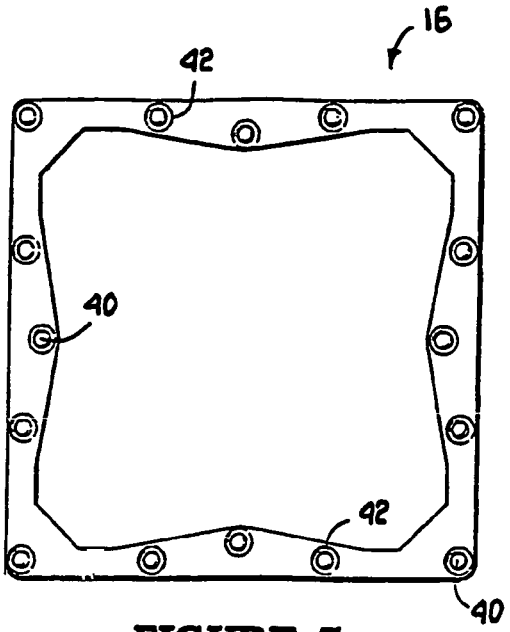
FIGS. 4 and 5 are respectively a plan view and an under plan view of the ring beam of the container.

As shown in FIGS. 1 and 2 the poles of a pair of poles 14 on each side of the cage are connected together by diagonal tension resisting bracing tendons 45 and 46. The tendons, in this embodiment of the invention, are cables made from stranded stainless steel wire and have a diameter of about 3 mm. The tends, which are cut to exact length, are anchored to the poles 14 as shown in FIG. 3, by having their ends passed through holes 14*a* in their side walls adjacent their ends and, with the two poles closer together than they would be in the assembled container, from larger diameter holes 14*b* in their rounded ends, as shown in FIG. 3. Steel ferrules 47 are then swaged to the ends of the tendons. With the poles 14 then spaced from each other by exactly the distance separating their locating sockets 34 and 40 in the pallet and ring beam the ferrules 47 will be pulled into the pole tubes to abut their inner walls around the side wall holes through which the cables pass and with this pole spacing the tendons are under very slight tension but could be very slightly slack with this slack rapidly being taken up by the slightest tilting movement of the poles to which the tendons are fixed in the direction of the plane in which they are located.

FIGS. 1 and 2 show the bracing tendons 45 and 46 extending between a pair of central poles on each side of the twelve pole cage. With a four pole cage the tendons will extend from corner to corner of the side of the cage which carries them. To increase the lateral support of the container bag in the illustrated twelve pole or even a sixteen pole cage the tendons could extend between the corner poles behind the poles, on the same side of the container, between them.

In use, with reference to FIG. 2, it will be appreciated that any tendency for either the pallet 12 or the ring beam 16 to move horizontally relatively to the other by a tilting of the poles 14 will be arrested by one or the other of the tendons becoming tensioned against whatever force is attempting to cause the perpendicularity of the poles relatively to the pallet and ring beam, in a plane including the braced poles, to be upset. The fact that the cage is braced on at least two adjacent and in this case all four of its sides similarly ensures that neither the pallet nor the ring beam are capable of rotating about the vertical axis of the container relatively to each other regardless of whatever usual dynamic loads are imposed, in use, on a stack of the containers when fully loaded.

To accommodate the poles 14 in the knocked-down condition of the container framework the pallet grooves 17, as shown in FIG. 1, have rounded undersides and depth sufficient to contain the poles with their upper surfaces below the upper surface of the pallet with the bracing cables 45 and 46 on the poles which carry them, passing over the groove separating walls. Also, as shown in FIGS. 6 and 7, the pallet base includes a closure plug 48 which includes two or four diametrically opposite locking formations, shown in dotted lines in the drawings, which project radially from its circumferential periphery to be releasably engageable in bayonet-type slots in the wall of the aperture 20 to enable the plug to be releasably locked into the aperture 20 from the underside of the pallet by upward and then rotational movement of the plug 48 by means of a handle, not shown, which could be moulded into the underside of the plug.

The pallet base 12 of the container additionally includes a passive programmable microchip, not shown, which is embedded in its plastic material, after moulding, and which is programmed to provide its identity, storage information and the like on electronic interrogation.

The container bags of the invention for use with the support structure thus far described may be flexible bags which are made from a suitable plastics film material such as polyethylene with the gauge of the film being dependent on the nature of the material which the bag is to contain but will typically lie in a range of between 90 and 120 microns. Alternatively, again in dependence of the nature of the material which is to be loaded into the bag, the bag could be made from a suitably woven or net material or a combination of these materials. For example, in the transportation and storage of fresh produce such as oranges, mangoes, apples, pears and the like the bags would be made from a suitable netting to permit adequate ventilation through the fruit in the bag. Additionally, if the container is to contain liquid or particulate material, such as fertilizer, which is highly hydroscopic, the bag could be made from a robust woven plastics material which is laminated on its inner surface with an air impervious polypropylene film or if the bag is to be used to carry processed frozen vegetables it could be made from a suitable air impervious polyethylene.

Figure 8:
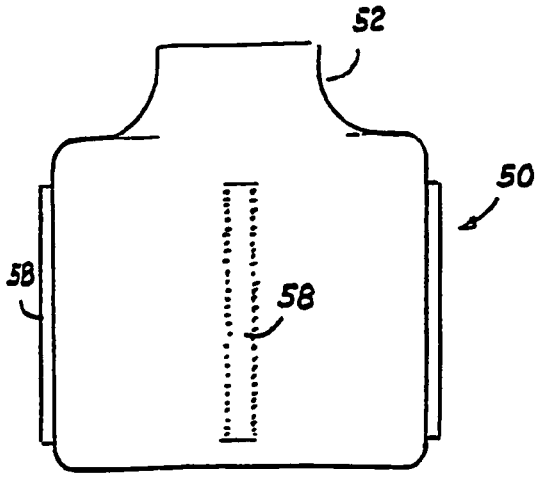
FIG. 8 is a side elevation of one embodiment of the bulk storage bag for use with the container of the invention.
Figure 9:
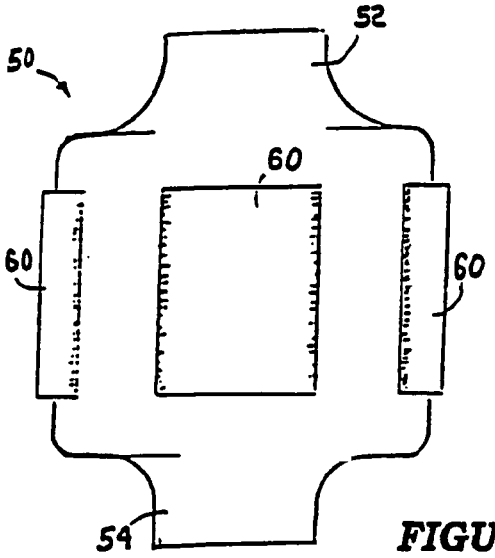
FIGS. 9 and 10 are side elevations of yet further embodiments of bags for use with the container of the invention.
Figure 10:
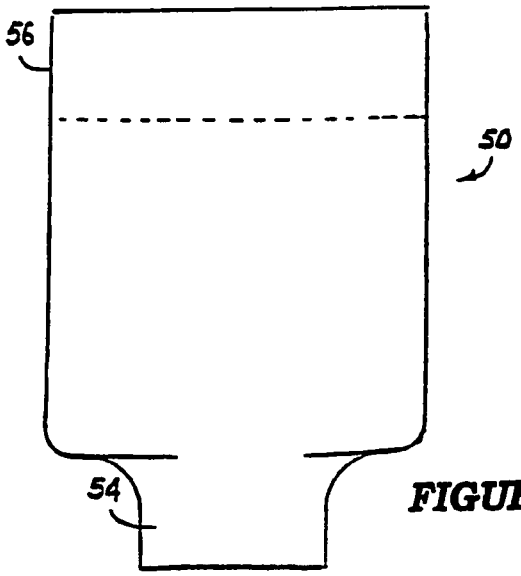

The examples of the bags 50, shown in FIGS. 8 to 10, are made to be initially tubular. The bags could include only upper reduced diameter inlet tubes 52 as shown in FIG. 8 in which case their inwardly folded bases would need to be cut out or at least slit through the pallet base aperture 20 for bottom discharge. Alternatively, the bag 50 could, as shown in FIG. 9, have, in addition to the inlet tube 52, a reduced diameter outlet tube 54 which is inwardly folded to close over the closed plug 48 on the pallet base 12 with the tube merely unfolding to discharge when the plug 48 is removed. In its simplest form the bag 50, as shown in FIG. 10, could be made to include an outlet tube 54 and an upwardly extended side wall portion 56 which is open at the top and which, during loading of the bag in the support structure, is merely folded down over the ring beam 16 onto the outside side wall of the bag to be filled with the extended portion 56 of the bag then being folded back over the upper surface of the material loaded in it. The side walls of the bags could include circumferentially spaced vertical tubular sleeves 58 which may be made to receive a single pole 14 or the sleeves 60, as shown in FIG. 9, could be sized to receive two adjacent poles. The sleeves are made integral with the bag material by stitching or heat welding in dependence on the nature of the material from which the bag is made. Alternatively, the bags could include horizontal slits which are arranged in vertical rows about the periphery of the bag to suit a desired pole configuration when they are to be loaded with a low density particulate material which is not very flowable. In this case the poles are fed from the outside of the bag into and out of the horizontal slits in a row so that the bag will be supported by the material between the slits on the outside of the poles.

An important feature of the intermediate bulk container of this invention is that with the simple and relatively lightweight support structure of FIGS. 1 to 7 and its various pole arrangements and suitable bulk container bags 50 the user of the intermediate bulk container of the invention has a wide range of choices as to the type of container support structure required to transport and store a wide variety of discreet objects or types of particulate material.

As an example of the versatility of the container of the invention, assuming it is desired to transport and store discreet objects such as low density table tennis or ping pong balls a simple four corner pole structure may well suffice in minimising the outward bulging of the container bags from between the poles 14. On the other hand, assuming that far denser golf balls were to be loaded into the containers a more robust and more closely spaced pole structure together with a heavier bag material would be required to minimise the outward bulging of the bag material from between the poles. In this case the eight pole configuration would probably suffice. For very high density particulate material such as fertilizer and even grain or rice it may be required that the full sixteen pole configuration is employed to inhibit excessive bag bulging.

With the above versatility of the container of the invention an organisation which is required to load a number of different materials into the containers of the invention need only keep suitable relatively cheap bags in stock to cater for the various materials for use with a compatible container support structure of the invention.

Yet another important feature of the container of this invention is the capability of a forklift being able, safely and without additional forklift lateral support, to convey three and at a push four loaded containers which are stacked one on the other. This is made possible by the interengagement of the pallet base and ring beam formations 32 and 44 respectively and the vertical rigidity of the support structure due to the depths of the pole 14 sockets 34 and 40 and the bracing tendons 45 and 46 which ensure that the stacked containers form a cohesive, stable structure.

Perhaps more importantly is the fact that eight containers may with absolute stability be stacked one on the other in a refrigerated or storage facility. This feat is achievable by the load of the individual bags 50 of the stacked containers being fully supported on the pallet bases 12 of the containers and being transferred through the stack from the pallet bases to the axially aligned poles 14 of the containers in the stack and from the poles to the surface on which the stack rests through the solid material of the pallet plinths 26 and 28. This load transfer is, at all times, without the load of the individual bags in the stack bearing on one another to unduly stress and further bulge the flexible material from which the bags are made.

After use, when the material in a container 10 of the invention has been emptied at its destination the ring beam 16 is lifted from the upper ends of the poles 14 and the poles are then lifted from their sockets 40 in the pallet base. The container bag is then removed from the pallet base. the poles 14 are placed in the grooves 46 in the pallet base, see FIG. 1, and the ring beam is placed over the pole ends in the grooves with its socket projections 42 pressed into the flared mouths 36 of the pallet base sockets 34 to effectively trap the poles in the pallet base grooves 17. A number of knocked-down pallets may be placed one on the other in a stack with the ring beam formations 44 located in the pallet base recesses 32 of the containers above them. The stacked containers may be strapped for shipping and the bottom pallet base in the stack will still be available for forklift handling.

The invention claimed is:

1. An intermediate bulk container comprising a storage container which is made from a suitable flexible material, a substantially rectangular forklift pallet base member which is made from a suitable plastic material and includes two pairs of parallel sided fork tine apertures with one pair of apertures extending across the pallet base from opposite sides of the base and the other pair from the remaining opposite sides to define four corner load supporting plinths and a single plinth between each pair of corner plinths, at least eight pole engaging sockets on an upper surface of said pallet base member which are arranged in a spaced relationship about a periphery thereof, at least eight metal poles, the lower end of each of which is engageable with a pole engaging socket on the pallet base member, a rigid pole location member which has substantially the same outer shape as the pallet base member and includes a central opening through which the storage container may be filled, at least eight pole engaging sockets in which the upper ends of the poles are releasably engageable, formations which project upwardly from said rigid pole location member and are engageable with recesses in an underside of the pallet base member which are vertically aligned with the formations on the pole location member so that in a vertical stack of the containers the formations on the pole location members will be releasably located in the recess formations in the pallet base plinths to prevent horizontal transverse dislocation of the containers from one another in the stack, and pole bracing means connecting a pair of poles on at least two adjacent sides of the container to each other with the bracing means consisting of two elongated tension resisting members which are attached to and extend diagonally between the upper and lower end portions of the pair of poles to which they are connected, said tension resisting members being flexible and slack in an assembled state wherein said slack in said tension resisting members is taken up upon tilting of said metal poles relative to one another in use to hold the poles in the planes in which they are located in the assembled container, being perpendicular to the base and pole locating member.

2. A container as claimed in claim 1 wherein the tension resisting members are permanently fixed to the poles which they connect and are stranded flexible metal cables.

3. A container as claimed in claim 2 wherein the pole locating member is moulded from a suitable plastics material.

4. A container as claimed in claim 3 wherein both the pallet base member and the pole locating member are moulded to be substantially hollow.

5. A container as claimed in claim 1 wherein the upper surface of the pallet base includes, between the pole sockets, elongated recesses in which poles may be stored and trapped when the pole location member is placed on the pallet base.

6. A container as claimed in claim 1 wherein the pallet base and the pole location member each include sixteen pole engaging sockets which are arranged in sets of five alongside each of their four outer edges with the corner sockets each being common to two sets of sockets.

7. A container as claimed in claim 3 wherein the upper and lower ends of the poles are rounded with the bases of the sockets in the pallet base and pole location member in which they are located, in use, being complementally shaped to the rounded pole ends.

8. A container as claimed in claim 7 wherein the rounded ends of the poles to which the tension resisting cables are connected and side walls of said poles adjacent both ends comprise holes with the tension resisting cables each including on each of their ends a stop formation which is dimensioned to pass through the holes in the rounded pole ends and to be trapped on the inside of the poles by the smaller diameter holes in their side walls.

9. A container as claimed in claim 1 wherein, when a plurality of loaded bulk containers are stacked vertically one on the other with their dislocation preventing formations engaged with those of a vertically adjacent container in the stack, their poles are in axial alignment with their ends separated from each other by solid material from which the pallet bases and the pole locating members are made so that the mass of the loaded containers above a lowermost container of the stack is transmitted from their pallet bases only through the axially aligned container poles to the surface on which the containers are stacked and not through the material in their storage containers.

10. A container as claimed in claim 1 wherein the pallet base carries a central load discharge aperture.

11. A container as claimed in claim 10 wherein the pallet base further includes a plug for closing the discharge aperture from the underside of the pallet with the side of the plug including formations which are releasably engageable in formations in the wall of the pallet base aperture releasably to lock the plug in the aperture.

12. A container as claimed in claim 1 wherein the pallet base and pole locating member dislocation preventing formations have elongated rectangular bases with each of the four sides of each formation tapering inwardly towards the opposite side of the formation.

13. A container as claimed in claim 1 wherein the pole locating member is a ring beam.

14. A container as claimed in claim 1 wherein the storage container is a bag which is made from a suitably flexible plastics sheet material.

15. A container as claimed in claim 14 wherein the storage bag is a bag which is made from a woven plastics material.

16. A container as claimed in claim 15 wherein the woven bag material is internally laminated with a suitable plastic film for containing a liquid or highly hydroscopic particulate material.

17. A container as claimed in claim 1 wherein the storage container is a bag which is made from a netting material.

18. A container as claimed in claim 14 wherein the storage bag includes an upper closable filling aperture.

19. A container as claimed in claim 14 wherein the storage container bag includes a closable outlet aperture in its base.

20. A container as claimed in claim 14 wherein the storage bag includes formations for releasably engaging at least selected cage poles.

* * * * *